US009481431B2

(12) United States Patent
Biraben et al.

(10) Patent No.: US 9,481,431 B2
(45) Date of Patent: Nov. 1, 2016

(54) STRUCTURE FOR SUPPORTING AND GUIDING A HOISTABLE MAST OF A SUBMARINE VEHICLE

(75) Inventors: Stéphanie Biraben, Angouleme (FR); Fabién Foucaud, Brie (FR); Cédric Albert, Mornac (FR); Philippe Paumier, Ruelle sur Touvre (FR)

(73) Assignee: DCNS, Paris (FR)

( * ) Notice: Subject to any disclaimer, the term of this patent is extended or adjusted under 35 U.S.C. 154(b) by 0 days.

(21) Appl. No.: 13/824,665

(22) PCT Filed: Jun. 26, 2012

(86) PCT No.: PCT/EP2012/062335

§ 371 (c)(1),
(2), (4) Date: Jun. 14, 2013

(87) PCT Pub. No.: WO2013/004549

PCT Pub. Date: Jan. 10, 2013

(65) Prior Publication Data

US 2014/0144364 A1 May 29, 2014

(30) Foreign Application Priority Data

Jul. 1, 2011 (FR) ..... 11 55961

(51) Int. Cl.
*B63G 8/38* (2006.01)
*B63G 8/04* (2006.01)

(52) U.S. Cl.
CPC . *B63G 8/38* (2013.01); *B63G 8/04* (2013.01); *B63B 2221/24* (2013.01)

(58) Field of Classification Search
CPC ..... B63G 8/06; B63G 8/38; B63G 2221/24; B63G 8/04; G02B 23/08
USPC ..... 114/339, 340; 343/709, 710; 359/402–406
See application file for complete search history.

(56) References Cited

U.S. PATENT DOCUMENTS 5,284,226 A * 2/1994 Makimura et al. ..... 187/408
5,634,424 A * 6/1997 Ortelli ..... 114/339

(Continued)

FOREIGN PATENT DOCUMENTS

DE 90 10 980 U1 10/1990
DE 10 2006 061294 B3 4/2008

(Continued)

*Primary Examiner* — Ajay Vasudeva
(74) *Attorney, Agent, or Firm* — Knobbe, Martens, Olson & Bear LLP

(57) ABSTRACT

The support and guidance structure includes a support (14) equipped with means of guidance (16) of the mast (12) in a raising direction (Z), including a wall (32) extending in this direction (Z), and delimiting a housing (33) for the mast (12). The guidance means (16) include two guide rails (18), borne by the support (14), and two additional guidance elements (20), borne by the mast (12), each operating in tandem with a respective rail (18). Each rail (18) forms stops (18A) immobilizing the related guidance element (20) in a second direction (Y) perpendicular to the raising direction (Z) and the wall (32). The guidance means (16) include another guide rail (18), borne by the support (14), and another additional guidance element (20), borne by the mast (12), and operating in tandem with the other rail (18). The other rail (18) forms stops (18A) immobilizing the other guidance element (20) in a third direction (X) perpendicular to the raising direction (Z) and the second direction (Y). The housing (33) is open on substantially all planes perpendicular to the raising direction (Z).

13 Claims, 2 Drawing Sheets

(56) References Cited

U.S. PATENT DOCUMENTS

| | | | | |
|---|---|---|---|---|
| 6,715,439 | B1 * | 4/2004 | Ortelli | 114/339 |
| 7,000,561 | B2 * | 2/2006 | Kruger et al. | 114/339 |
| 7,472,665 | B2 * | 1/2009 | Bertin | 114/339 |
| 7,549,386 | B2 * | 6/2009 | Bertin | 114/328 |
| 8,960,118 | B2 * | 2/2015 | Stella | 114/339 |

FOREIGN PATENT DOCUMENTS

| | | | |
|---|---|---|---|
| EP | 0 546 321 | A1 | 6/1993 |
| EP | 0 711 702 | A1 | 5/1996 |
| EP | 1 177 974 | A2 | 2/2002 |
| EP | 1 357 024 | A1 | 10/2003 |
| WO | WO 2008/050206 | A2 | 5/2008 |

* cited by examiner

STRUCTURE FOR SUPPORTING AND GUIDING A HOISTABLE MAST OF A SUBMARINE VEHICLE

FIELD OF THE INVENTION

This invention concerns a support and guidance structure for a hoistable mast for a submarine vehicle, also known as a periscopic mast.

Such hoistable masts are generally used to carry means of communication for the submarine vehicle, such as radio transmitter/receiver antennas, or to carry means of exploration of the environment of the submarine vehicle, such as radar antennas, sensors, or periscopes.

It should be noted that a hoistable mast of a submarine vehicle, in its raised position, is subject to substantial constraints due to the submarine environment in which the vehicle operates. In particular, when the vehicle advances with the mast raised, this mast is subject to a substantial longitudinal constraint due to the reaction force of the water.

BACKGROUND OF THE INVENTION

The prior art already contains a support and guidance structure for hoistable masts of a submarine vehicle, including:

- a support and guidance structure including a support equipped with means of guidance of the mast in translation in a raising direction, including a central wall, generally flat, extending longitudinally parallel to the raising direction, and delimiting a housing for the mast,
- guidance means including at least two guide rails, borne by the support, extending in the raising direction, and at least two additional guidance elements, borne by the mast and each working in tandem with a respective rail, whereby each rail forms stops for the related guidance element, immobilising the guide element in a second direction perpendicular to the raising direction and to the central wall, and
- whereby the support and guidance structure includes means of fixation of the support to a structural part of the vehicle.

The means for guidance of the mast in translation in the raising direction allow for longitudinal raising of the mast between a retracted position inside the body of the vehicle and a raised position.

Such a support also includes means of fixation to the body, which is a structural component of the vehicle. Thus, the mast and its support may be brought together during a single assembly operation within the submarine vehicle.

Normally, the support includes four walls surrounding the mast transversely to the raising direction, so as to form a transversely closed housing for the mast. A support as described above is described in EP 1 177 974 B1.

SUMMARY OF THE INVENTION

The invention seeks in particular to reduce to improve the stability of the mast, whilst reducing the mass and encumbrance of the support.

To this end, the invention concerns, in particular, a support and guidance structure for hoistable masts of a submarine vehicle, in which:

- the support and guidance structure includes a support equipped with means of guidance of the mast in translation in a raising direction, including a central wall, generally flat, extending longitudinally parallel to the raising direction, and delimiting a housing for the mast,
- the guidance means include at least two guide rails, borne by the support, extending in the raising direction, to work in tandem with at least two additional guidance elements, borne by the mast and each working in tandem with a respective rail, whereby each rail forms stops for the related guidance element, suited to immobilise the guide element in a second direction perpendicular to the raising direction and to the central wall, and
- whereby the support and guidance structure includes means of fixation of the support to a structural part of the vehicle, characterised in that:
- the guidance means include at least one other guide rail, borne by the support, to work in tandem with at least another additional guidance element, borne by the mast and working in tandem with the other rail, whereby the other rail forms stops for the other guidance element, suited to immobilise the other guide element in a third direction perpendicular to the raising direction and the second direction, and
- the housing is open in the second direction, which is perpendicular on essentially all planes to the raising direction.

Thus, it is possible to provide a support that is less cumbersome than a support with walls surrounding the mast. In fact, such a support, including a wall on a single side of the mast, has a dimension in a direction perpendicular to the raising direction that is smaller than the dimension of a prior-art support in the same direction, which includes a wall on each side of the mast.

Additionally, the presence of the stops both in the second and third direction allows for absorption of the forces in these two directions, and thus providing good stability to the mast, even when the support only has one wall.

Optionally, a support and guidance structure according to the invention includes one or more of the following characteristics, taken alone or in all technically possible combinations:

- The support includes horizontal reinforcement ribs extending between the guide rails.
- The support includes two lateral posts extending perpendicularly to the central wall, each post including at least one guide rail for the mast, in which the stops immobilise the related guidance element in the second direction, and the central wall also includes at least one guide rail for the mast, the stops of which immobilise the related guidance element in the third direction.
- The guide rail of the wall is arranged on the wall in proximity to one of the lateral posts.

The invention further concerns an assembly of a hoistable mast of a submarine vehicle and a support and guidance structure as described above, in which the mast bears:

- at least two guidance elements in addition to the two guide rails, each operating in tandem with a respective guide rail, such that each rail forms stops for the related guidance element, immobilising this guidance element in the second direction, and
- another guidance element in addition to the other guide rail, operating in tandem with this other rail, whereby this other rail forms stops for the other guidance element, immobilising this other guidance element in the third direction.

Advantageously, the assembly includes one or more of the following characteristics, taken alone or in all technically possible combinations:

The support has at least one dimension, measured perpendicularly to the central wall, that is smaller than a dimension of the mast in the same direction.

The assembly includes mast that is asymmetrical to a central vertical plane perpendicular to the central wall, having a first half with a mass greater than that of a second half, in which the guide rail arranged on the wall is arranged on the side of the half of the mast with greater mass.

On a plane perpendicular to the raising direction, the mast has a dimension, measured in the second direction, that is greater than its dimension measured in the third direction.

The mast includes a trolley comprising two guidance elements for each rail, arranged on each end of the trolley in the raising direction.

The mast includes means of operation, borne by the trolley, selected from means of communication, such as a radio transmitter and/or receiver antenna, means of exploration of the environment of the submarine vehicle, such as a radar antenna, an optronic sensor, or any other type of sensor.

The support bears a raising jack, and the mast includes a guide tube for the jack, whereby at least two guidance elements for the mast are affixed to the guide tube.

The invention lastly concerns a submarine vehicle including a structural part for receiving at least one hoistable mast, characterised in that it includes an assembly as described above, in which the support is affixed to this structural part via fixation means.

Advantageously, the submarine vehicle includes one or more of the following characteristics, taken alone or in all technically possible combinations:

The assembly is included on the structural part such that the support is situated aft of the mast on the vehicle, in a longitudinal direction of the vehicle.

The structural part includes: a central bulkhead, opposite which the central wall of the support is arranged, two lateral bulkheads extending perpendicularly to the central bulkhead such that the structural part has a U-section in horizontal cross-section, and two ledges, each extending a respective lateral bulkhead, folded substantially parallel to the central bulkhead, such that the structural part envelops the support.

The fixation means include: two fixation elements, borne by the central wall, and extending between this central wall and the central bulkhead, two fixation elements, each borne by a respective post, each extending between the respective post and a respective lateral bulkhead, and two fixation elements, each borne by a respective post and each extending between the respective post and a respective ledge.

The fixation elements are jack screws.

BRIEF DESCRIPTION OF THE DRAWINGS

The invention will be better understood based on the following description, provided by way of example only, referring to the attached drawings, in which.

DETAILED DESCRIPTION OF THE PREFERRED EMBODIMENT

Figure 1:
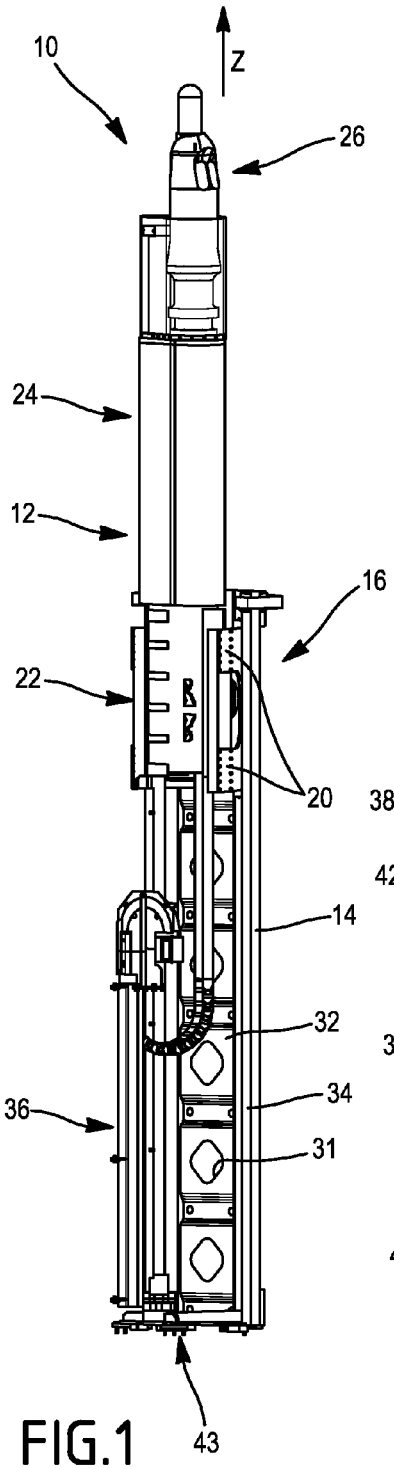
FIG. 1 is a side view of an assembly of a hoistable mast and a support for the mast, according to a first embodiment of the invention.

FIG. 1 shows an assembly 10 of a hoistable mast 12, in particular for a submarine vehicle, and a support 14 for the mast. In FIG. 1, the mast 12 is shown in its raised position.

The mast 12 is connected to the support 14 by means of the means 16 of guidance of the mast in translation in a vertical raising direction Z, for raising and lowering this mast 12.

The guidance means 16 include guide rails 18, borne by the support 14 and extending in the raising direction Z. Additionally, the guide means 16 include, for each guide rail 18, at least one additional guidance element 20, borne by the mast 12, to operate in tandem with the rail 18. The rails 18 and the guidance elements 20 are shown, in particular, in FIG. 2.

In the example shown in FIG. 1, three rails 18 are provided, as will be described below.

Advantageously, the mast 12 includes a first part 22, including the guidance elements 20, and a second part 24, integrated with the first 22, including means of operation 26. These means of operation 26 include, e.g., means of communication, such as a radio transmitter and/or receiver antenna, means of exploration of the environment of the submarine vehicle, such as a radar antenna, a sensor, or a periscope, or any other equipment capable of being integrated into a mast of a submarine vehicle.

In accordance with the first embodiment, the support 14 includes a central wall 32, generally flat in shape, extending longitudinally parallel to the raising direction Z. Advantageously, the central wall 32 includes a plurality of trim openings 31.

In the following "second direction Y" refers to the horizontal direction perpendicular to the raising direction Z and the central wall 32, and "third direction X" refers to the direction perpendicular to the directions Y and Z.

Figure 2:
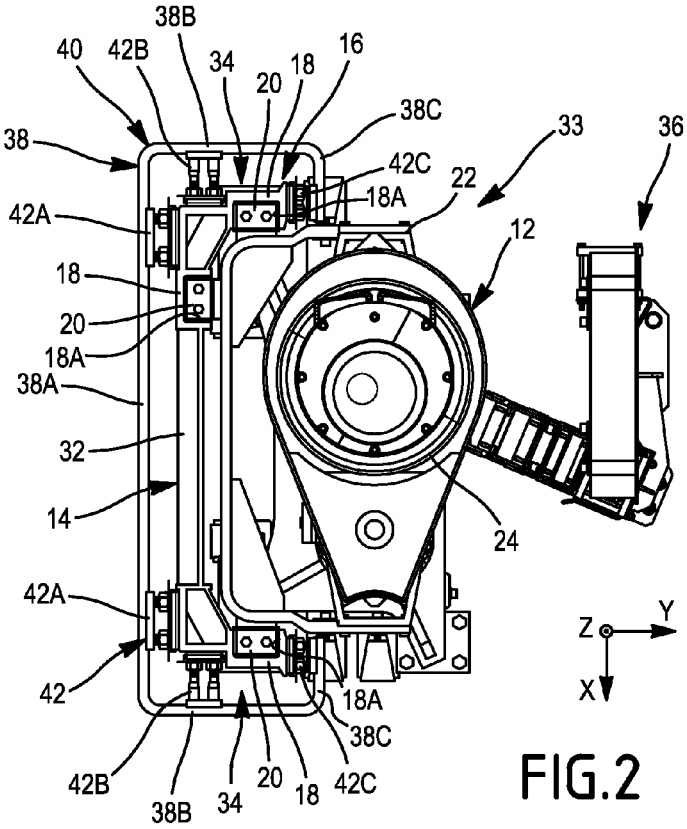
FIG. 2 is a top view of the assembly of FIG. 1.
Figure 4:
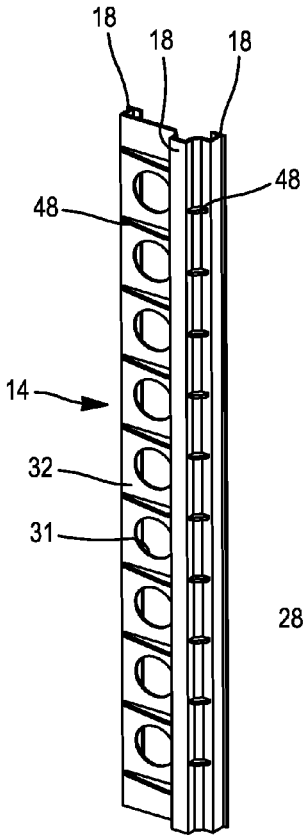
FIG. 4 is a perspective view of support of the assembly of FIG. 3.

The support 14 also includes two lateral posts 34, extending in the second direction Y, perpendicularly to the central wall 32, as shown in FIG. 2, such that the support 14 has a substantially U-shaped section in a cross-section perpendicular to the raising direction Z. Preferably, these lateral posts 34 are integrally formed with the central wall 32.

Each post 34 has a guide rail 18, whereby the guide rails 18 are preferably arranged opposite one another.

Likewise, the wall 32 includes at least one guide rail 18 in order to optimise the stability of the mast 12 when it moves in the raising direction Z.

Each rail 18 that is borne by one of the posts 34 has a U-shaped cross-section including lateral parts forming the branches of the U, between which the guidance element 20 is arranged. These lateral parts form stops 18A for each related guidance element 20 so as to immobilise the guidance element 20 in the second direction Y. Furthermore, the rail 18 borne by the wall 32, which is similar in configuration, forms stops 18A for each related guidance element 20 so as to immobilise the guidance element 20 in the third direction X.

The mast 12 is thus held on the support 12 in the second and third directions Y, X, and thus can only be moved in translation in the raising direction Z. This holding of the mast 12 on the support 14 facilitates the manipulation of the assembly 10 when it is mounted onto a submarine vehicle.

Additionally, the presence of the stops 18A both in the second Y and third direction X provides good stability to the mast 12, in particular by absorbing the forces in these two directions Y,X.

The guide rail 18 of the wall 32 is advantageously borne by this wall 32 in proximity to a lateral post 34, so as to benefit from the sturdiness of this lateral post 34.

In some cases, in particular in the example described, the mast 12 is not symmetrical with regard to a central plane perpendicular to the central wall 32, but has a first half with a mass greater than that of a second half. In this case, the guide rail 18 of the wall 32 is preferably arranged on the side of the half of the mast with greater mass in order to support it firmly.

Such a support 14 delimits a housing 33 for the mast 12, which housing 33 is open on substantially all horizontal planes. In fact, in the example shown, the open housing 33 is delimited only by the wall 32 and the posts 34.

Thus, taking into account the second, horizontal direction Y, perpendicular to the central wall 32, it is possible to provide for the mast 12 to extend beyond the lateral posts 34 in this second direction Y. It should also be noted that the support 14 has a dimension smaller than that of the mast 12 in this second direction Y.

It is thus clear that a support 14 according to the invention is less cumbersome than a prior-art support, which transversely surrounds the mast, and thus extends beyond the mast in all directions perpendicular to the raising direction Z.

Advantageously, the assembly 10 includes means of motorisation 36 of the mast 12 to drive the mast 12 in the raising direction Z. These means of motorisation 36 may be of any known type. Because the house 33 delimited by the support 14 is open, access to the mast 12 for these means of motorisation 36 is relatively simple.

In order to affix the assembly 10 to a structural part 38 of the vehicle, the support 14 bears means 40 of fixation provided to this end, in particular those seen in FIG. 2. This structural part 38 is also referred to as the "body".

The structural part 38 includes a central bulkhead 38A and two lateral bulkheads 38B extending perpendicularly to the central bulkhead 38A, such that the structural part 38 has a U-shaped horizontal cross section. The structural part also includes two ledges 38C, each extending a lateral bulkhead 38B, folded substantially parallel to the central bulkhead 38A, such that the structural part 38 envelops the support 14.

In the example shown, the fixation means 30 include fixation elements 42, borne by the support 14.

Each fixation element 42 consists, e.g., of a jack screw extending between the support 14 and the structural part 38.

The fixation means 30 include, e.g., six fixation elements 42, amongst which:

- two fixation elements 42A are borne by the central wall 32, and extend up to the central bulkhead 38A,
- two fixation elements 42B are each borne by a respective post 34, and each extend up to a respective lateral bulkhead 38B, and
- two fixation elements 42C are each borne by a respective post 34, and each extend up to a respective ledge 38C.

Thus, the fixation elements 42A, 42C immobilise by locking the support 14 in the second direction Y, between the central bulkhead 38A and the ledges 38C, and the fixation elements 42B immobilise by locking the support 14 in the third direction X, between the lateral bulkheads 38B. In other words, the fixation elements 42 form means of support for the support 14 on the structural part 38 in the second Y and third direction X.

The fixation means 30 also include means of screwing into the floor 43, shown in FIG. 1.

Figure 3:
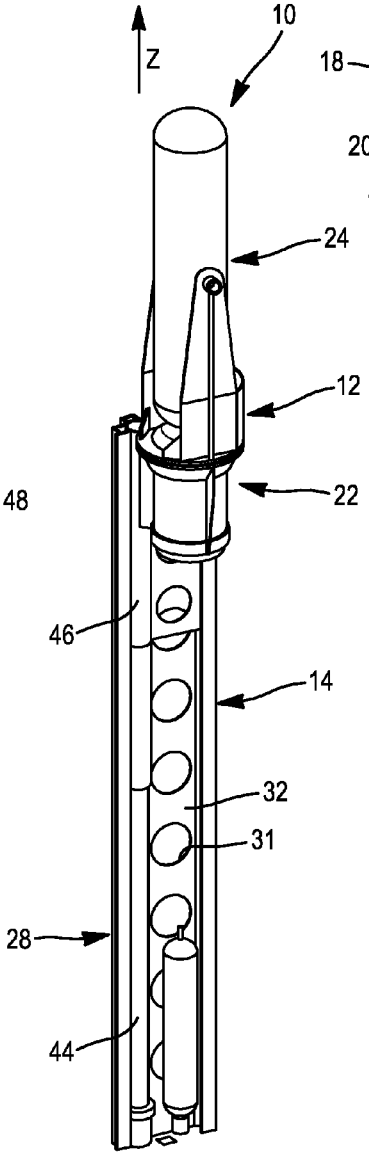
FIG. 3 is a perspective view of an assembly of a hoistable mast and a support for the mast, according to a second embodiment of the invention.
Figure 5:
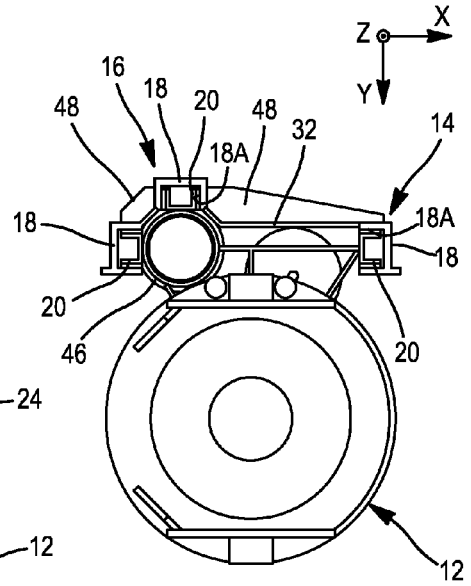
FIG. 5 is a top view of the assembly of FIG. 3.
Figure 6:
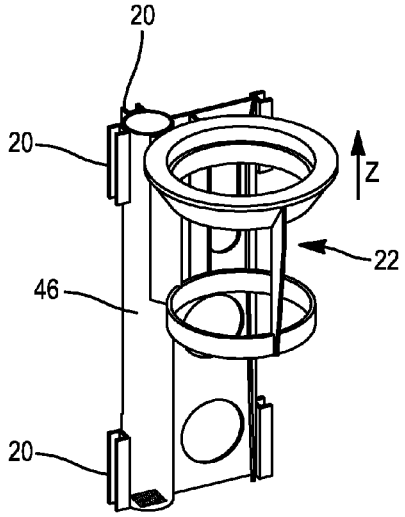
FIG. 6 is a perspective view of part of the mast the assembly of FIG. 3.

FIGS. 3 and 6 show an assembly 10 according to a second embodiment of the invention. In these figures, the elements analogous to those of the foregoing figures are indicated by identical references.

According to this second embodiment, and contrary to the first embodiment described above, the mast 12, in the second direction Y, perpendicular to the central wall 32, has a dimension greater than its dimension in the third horizontal direction X.

In other words, the wall 32 extends parallel to the smaller dimension of the mast 12, and thus has a width substantially equal to the smaller dimension of the mast 12. Thus, the support 14 is even less cumbersome than that of the first embodiment.

Optionally, the support 14 includes horizontal reinforcement ribs 48, extending between the guide rails 18, improving the mechanical resistance of the support 14, in particular its resistance to the constraints induced by the forces applied to it by the water in which the vehicle moves with the mast 12 raised.

In this second embodiment, the first part of the mast 12 forms a trolley 22 to bear the second part 24 of the mast 12. The trolley 22 includes two guidance elements 20 for each rail 18, which are arranged on each end of the trolley 22 in the raising direction Z.

The second part 24 includes a payload, e.g., an optronic sensor, a radar, a means of communication, or any other device required for a mission of the vehicle.

Optionally, the means of motorisation 28 include a jack 44 that operates in tandem with the trolley 22, in particular via a guide tube 46 of the jack with regard to the support 14, borne by the trolley 22, so as to increase its rigidity. Advantageously, the guidance elements 20 for at least two rails 18 are affixed on the guide tube 46.

Advantageously, the assembly 10 is included on the structural part 38 of the vehicle such that the support 14 is situated aft of the mast 12, in a longitudinal direction of the vehicle. Thus, the forces applied to the mast 12, e.g., by the water in which the vehicle is moving, from fore to aft on the vehicle, are transmitted optimally to the support 14.

It should be noted that the invention is not limited to the embodiments described above, and could present various variants without exceeding the scope of the claims.

In particular, the support 14 could bear different types of hoistable masts, to the extent that they are compatible with the guidance means 16. In other words, it is possible to provide standard supports, in which case the submarine vehicle would be suited to receive such supports no matter what mast it bears.

The invention claimed is:

1. A submarine vehicle comprising a structural part configured to receive at least one hoistable mast, said submarine comprising an assembly of a hoistable mast of a submarine vehicle and a support and guidance structure, wherein:

- the support and guidance structure comprises a support equipped with a guidance device for guiding the mast in translation in a raising direction, said support comprising a central wall, generally flat, extending longitudinally parallel to the raising direction, and delimiting a housing for the mast,
- the guidance device comprises at least two guide rails, borne by the support, extending in the raising direction, to operate in tandem with at least two guidance elements, borne by the mast and each of the at least two guidance elements operating in tandem with one of the at least two guide rails, whereby each of the at least two guide rails form stops for the related guidance element that operates in tandem with one of the at least two guide rails, suited to immobilize the related guidance element in a second direction perpendicular to the raising direction and perpendicular to the central wall, and the support and guidance structure comprises a fixation device configured to fix the support to a structural part of the vehicle, the guidance device comprises at least one other guide rail, borne by the support, to operate in tandem with at least another guidance element, borne by the mast and operating in tandem with the at least one other guide rail, whereby said at least one other rail forms stops for said at least another guidance element, suited to immobilize said at least another guidance element in a third direction perpendicular to the raising direction and the second direction, and the housing is open in the second direction, on all planes that are perpendicular to the raising direction, and wherein the mast bears:

the at least two guidance elements in addition to the two guide rails, each operating in tandem with a respective guide rail, such that each guide rail forms the stops for the related guidance element, immobilizing the related guidance element in the second direction, and the at least another guidance element in addition to the at least one other guide rail, operating in tandem, whereby the at least one other rail guide forms stops for the other at least another guidance element, immobilizing the at least another guidance element in the third direction, and the support is affixed to the structural part via the fixation device, and wherein the structural part further comprises:

a central bulkhead opposite which the central wall of the support is arranged, two lateral bulkheads extending perpendicularly to the central bulkhead, such that the structural part has a U-shaped horizontal cross section; and two ledges, each extending a respective lateral bulkhead, folded substantially parallel to the central bulkhead, such that the structural part envelops the support.

2. The submarine vehicle according to claim 1, in which the fixation device comprises:

two fixation elements borne by the central wall, and extending between the central wall and the central bulkhead, two fixation elements, each borne by a respective post, and each extending between a respective post and a respective lateral bulkhead, and two fixation elements, each borne by a respective post, and each extending between the respective post and a respective ledge.

3. The submarine vehicle according to claim 2, in which the fixation element comprises jack screws.

4. The submarine vehicle according to claim 1, in which the assembly is comprised on the structural part such that the support is situated aft of the mast on the vehicle, in a longitudinal direction of the vehicle.

5. The submarine vehicle according to claim 1, in which the support comprises horizontal reinforcement ribs extending between the guide rails.

6. The submarine vehicle according to claim 1, in which the support comprises two lateral posts extending perpendicularly to the central wall, each of the two lateral posts comprising at least one of the at least one other guide rail for the mast, in which the stops immobilize the related guidance element in the second direction, and the central wall also includes at least one of the at least one other guide rail for the mast, the stops of which immobilize the related at least another guidance element in the third direction.

7. The submarine vehicle according to claim 6, in which the at least one other guide rail is arranged on the central wall in proximity to one of the lateral posts.

8. The submarine vehicle according claim 1, in which the support has at least one dimension, measured perpendicularly to the central wall, smaller than a dimension of the mast in the same direction.

9. The submarine vehicle according to claim 8, wherein:

the support comprises two lateral posts extending perpendicularly to the central wall, each post comprising at least one of the at least two guide rails for the mast, in which the stops immobilize the related guidance element in the second direction, and the central wall also comprises at least one of the at least one other guide rail for the mast, the stops of which immobilize the related at least another guidance element in the third direction, the guide rail of the wall is arranged on the wall in proximity to one of the lateral posts, the mast that is asymmetrical to a central vertical plane perpendicular to the central wall, which mast has a first half with a mass greater than that of a second half, in which the guide rail arranged on the wall is arranged on the side of the half of the mast with greater mass.

10. The submarine vehicle according to claim 8, in which, on a plane perpendicular to the raising direction, the mast has a dimension, measured in the second direction, that is greater than its dimension measured in the third direction.

11. The submarine vehicle according to claim 1, in which the mast includes a trolley comprising two of the guidance elements for each rail, arranged on each end of the trolley in the raising direction.

12. The submarine vehicle according to claim 11, in which the mast comprises an operator, borne by the trolley, selected from the group consisting of a communicator, an exploration device configured to explore the environment of the submarine vehicle and any other type of sensor.

13. The submarine vehicle according to claim 11, in which the support bears a raising jack, and the mast comprises a guide tube for the jack, whereby at least two of the guidance elements for the mast are affixed to the guide tube.

* * * * *